United States Patent [19]

Kobler

[11] Patent Number: 4,720,091

[45] Date of Patent: Jan. 19, 1988

[54] PRINTED COPY FOLDING AND ASSEMBLY APPARATUS

[75] Inventor: Ingo Kobler, Anhausen, Fed. Rep. of Germany

[73] Assignee: M.A.N.-ROLAND Druckmaschinen Aktiengesellschaft, Augsburg, Fed. Rep. of Germany

[21] Appl. No.: 892,712

[22] Filed: Jul. 31, 1986

[30] Foreign Application Priority Data

Aug. 2, 1985 [DE] Fed. Rep. of Germany ..... 3527712

[51] Int. Cl.[4] ..... B65H 5/30

[52] U.S. Cl. ..... 270/57; 271/280

[58] Field of Search ..... 270/57, 32, 41–51, 270/6–9, 12–15, 21.1, 20.1; 493/340, 363, 364, 365, 370, 324, 357–360, 344, 416–417; 271/280–282

[56] References Cited

U.S. PATENT DOCUMENTS

| | | | |
|---|---|---|---|
| 3,162,434 | 12/1964 | Hepp | 270/57 |
| 3,877,692 | 4/1975 | Kluge et al. | 270/57 |
| 4,402,496 | 9/1983 | Muller | 270/57 |
| 4,516,759 | 5/1985 | Kobler | 270/12 |
| 4,531,722 | 2/1985 | Woerner | 270/48 |

*Primary Examiner*—E. H. Eickholt

*Attorney, Agent, or Firm*—Frishauf, Holtz, Goodman & Woodward

[57] ABSTRACT

To provide double-infolded printed copy substrates for short copies, a collection and assembly apparatus assembles copy of a first type, for example representative of an advertisement for ladies' fashions, with folded copy of a second type, for example representative of men's fashions. The apparatus forms a first cross fold in a first transverse folding stage (5, 7), typically a folding blade-folding cylinder unit, and forms a longitudinal fold by a longitudinal folding stage (13, 14), typically a folding blade (14) pushing printed copy between gripping rollers (13). To assemble and collect printed copy of the two types above each other for conjoint longitudinal folding by the longitudinal folding stage (13, 14), printed copy, delivered sequentially on a transport belt (12), is delayed and placed above printed copy arriving subsequently on the belt by a collection and assembly apparatus which includes a switching apparatus (16', 40), selectively guiding printed copy of the first type in a detour path, while letting printed copy of the second type pass through, so that the printed copy in the detour path can be placed, with edges in alignment, on a subsequently arriving second-type printed copy. The detour path may be defined by the circumference of a rotating cylinder (FIG. 2: 16) or by a separate belt way (FIG. 3: 18, 19). The detour path defined by the belts has the additional advantage that the length of the detour path is adjustable so that substrate copy of various dimensions can be readily accomodated by the apparatus.

12 Claims, 3 Drawing Figures

PRINTED COPY FOLDING AND ASSEMBLY APPARATUS

Reference to related application, assigned to the assignee of the present invention, the disclosure of which is hereby incorporated by reference: U.S. Ser. No. 892,713, filed July 31, 1986, KOBLER & SCHNEIDER.

The present invention relates to folding apparatus to provide transverse fold in printed products derived from a printing machine, for example from a web-type printing machine in which the printed web is passed over a folding triangle or folding former, and then cut and slit. The folding former forms a first or longitudinal fold, the subsequent cutting apparatus a first transverse (or second) fold.

BACKGROUND

Various types of folding apparatus utilize folding formers in which one or more webs are passed over the former, for forming a first fold, which will be longitudinal. The printed web is then pulled off the former with pull-off rollers, may be perforated, and then applied to a second folder which forms a transverse fold. The second folding apparatus may form two transverse folds. Customarily, the transverse folding apparatus comprises a pair of cylinders forming a cutter and a folding blade cylinder pair and a folding flap or gripper cylinder. By suitable control of needles or needling pins, the web, after having having been cut to provide printed substrates of a predetermined length, can be folded and collected on the folding blade cylinder.

In known folding apparatus, the printed substrates, which may be single sheets or superimposed multiple sheets, can be applied to a subsequent folding apparatus to form a third fold which, customarily, is formed by a pair of rollers or cylinders between which a folding blade can be inserted to form a longitudinal pinch fold. This, then, will be a second longitudinal fold, although the further folding apparatus may also provide a transverse fold.

Folding apparatus of this type can have one or two output transport systems for supplying the printed substrates singly or separately. Inserts into newspapers, however, had to be manually if the printed products were of different types. It is also difficult to insert transversely folded products of different characteristics or different types on a collection cylinder after the third fold since the third fold customarily, is a longitudinal fold and substrates of different types could no longer be readily separated from each other. For example, an outer printed sheet would no longer surround an inner printed sheet, which, however, is desirable for newspaper readers, for example. As an illustration of different types of substrates, one may consider that one type may be an advertising insert, for example for ladies' wear, and the other an advertising insert for men's wear.

THE INVENTION

It is an object to improve a folding apparatus so that, selectively, the output behind a third fold—preferably a longitudinal fold—of printed substrates of different types can be supplied folded inside each other, that is, the outer printed substrate should surround the inner one.

Briefly, a collection and assembly apparatus is provided to assemble copy substrates, for short "copy" of the first type with the folded copy of the second type prior to the formation of the longitudinal fold, so that, upon formation of the longitudinal fold, the printed copy of the first and second type will be assembled together. The apparatus requires that the printed copy of the first and second type, which can be received in one or two different transport paths, be associated above each other with the edges in alignment, so that, upon formation of the subsequent fold, the two types of printed substrates will be creased at the same point, to interleaf the respective substrates.

In accordance with a feature of the invention, the respective copies, i.e. copy substrates are guided in two paths, selectively, so that one copy can pass through the collection and assembly apparatus, whereas a subsequent copy is deflected to pass via a detour path, which delays the appearance of the second substrate with respect to the first. The detour path is so arranged that, at the end thereof, the first and second printed copy will appear at a given point at the same time, so that the edges will be superposed, and can then be folded in a subsequent folding apparatus together.

The apparatus has the advantage that known folding apparatus can be utilized, as before, while reducing the insertion of folded products of different types to half the previously required effort, since the third folding apparatus can receive the respective printed goods or copies of the first and second type in alignment; these first and second-type printed goods copies may already be transversely folded substrates. The apparatus, thus, is placed in advance of a further folding apparatus and associates different types of printed goods for a common folding, thus eliminating manual insertion. In accordance with a feature of the invention, selectively, the third fold may be bypassed and the respective printed substrates be delivered to a conveyor.

DRAWINGS

DETAILED DESCRIPTION

Figure 1:
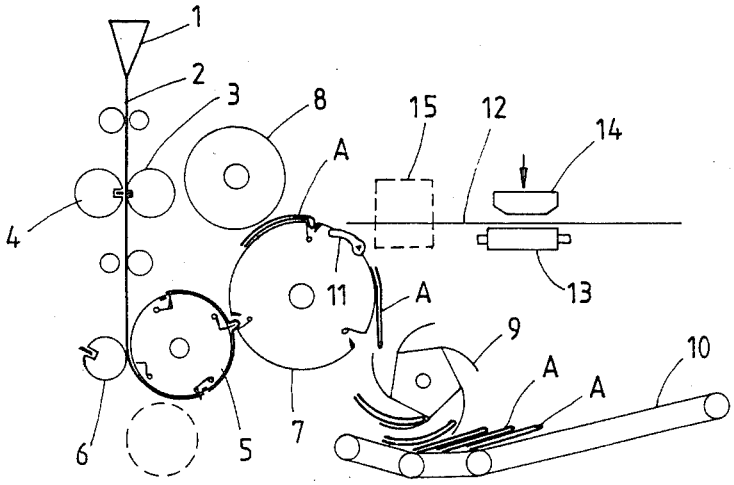
FIG. 1 is a schematic representation of the folding apparatus with the collection and assembly portion thereof shown generally.

A standard customary folding apparatus for printed substrates is generally shown in FIG. 1. A folding former 1 receives a printed web 2, which may carry both prime and verso printed subject matter. The supply of the web 2 can be in accordance with any standard arrangement, and, rather than over a folding former 1, may for example utilize turning rods or the like. If the web is supplied over the former 1, a longitudinal fold is formed in the web. This is defined as the first fold. The web 2 may be slit or cut at the apex of the former 1, so that two superposed webs will be received from the former 1. The webs are pulled off by standard pull-off rollers and then passed through a pair of perforating rollers 3, 4, to be then applied to a folding blade-cutting knife cylinder pair 5, 6, cooperating with the folding gripper or folding flap cylinder 7. The cutting cylinder 6, applied against the folding blade cylinder 5, cuts the web 2—which may be one or more superimposed webs—into suitable lengths, and folding blades on the cylinder 5 then push the web into folding grooves or flaps in the cylinder 7. The folded edge is gripped in the cylinder 7 and, upon rotation of the cylinder, the respective portions of the sheets on the cylinder 5 are peeled off the cylinder 5 and transported by the cylinder 7 about its circumference, in the form of the substrates A. A further folding blade cylinder 8, shown only schematically, may form an additional transverse fold in the substrates by pushing the substrates A on the circumference of the cylinder 7 into additional grooves, to be held therein by grippers at the edges where they are pushed into the grooves, to form an additional fold.

The substrates A can be delivered—as is customary—from the folding cylinder 7 on a conveyor belt 10, separated from each other by a distribution or paddle or bucket wheel 9, which delivers the printed substrates or copies A on the conveyor belt 10 in imbricated or staggered alignment. Alternatively, it is possible to deliver the printed substrates A for a third fold—customarily the second longitudinal fold—by a lifting tongue 11 to a conveyor 12, from which the printed substrates are then supplied to the longitudinal blade-roller folding apparatus 13, 14. This apparatus includes a pair of spaced rollers 13, between which the printed subject matter is pushed by the reciprocating blade 14. A further paddle wheel or the like, not shown, or other transport mechanism beneath the roller 13 then removes the printed substrates, folded once in the former 1 and a second time in the folding apparatus 13, 14 from the folding system.

In accordance with a feature of the invention, a collection and assembly apparatus 15 is located in advance of the third fold, that is, in advance of the second longitudinal fold—considering the former 1 to form the first fold. The collection and assembly apparatus 15 insures that the sequentially arriving printed products A—having been folded transversely once or possibly twice by the folding blade cylinders 5, 7 and, if desired, 8, 7 as well, are collected and delivered to the longitudinal folding apparatus 13, 14 in edge-aligned condition. Sequential folded substrates, identified for simplicity as A1 and A2, can thus be assembled in vertical alignment. It is particularly advantageous to separate the folded substrates A1, A2 by passing one substrate over a detour path to introduce a time delay with respect to a substrate which passes straight through the apparatus, so that the time-delayed first substrate can be placed on the succeeding, following one, with the edges in alignment. When such collected substrates A1, A2 are then applied to the folding apparatus 13, 14 to form a subsequent longitudinal fold, the end product will be formed by two interleaved, inserted, preferably once transversely folded sheets, which then can be placed simply and inexpensively for example as insert into newspapers or the like, in one single working step. The insertion operation, thus, can be carried out rapidly and hence inexpensively.

Figure 2:
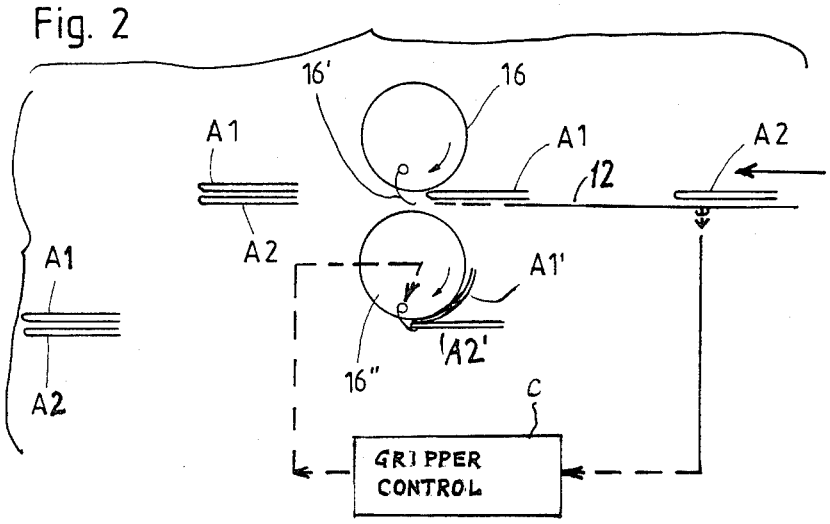
FIG. 2 illustrates the sequential operation of the folding and collection apparatus.

FIG. 2 illustrates a first embodiment of a collection and assembly apparatus, highly schematically, while also illustrating the mode of operation. A cylinder 16 is provided which has grippers 16' thereon, suitably controlled to grip printed subject matter or printed substrates which are fed thereto. For example, a substrate A1 arriving from the right and traveling towards the left—the reverse of the direction shown in FIG. 1—is gripped by the gripper 16', and passed around the circumference of the gripper cylinder 16. Preferably, the circumference of the cylinder 16 and the length of the substrate A1, as well as the speed of operation of the cylinder 16 in relation to the speed of the transport belt 12 which supplies the substrate A1 and a subsequent substrate A2 are so matched together that, after one revolution of the cylinder 16, the leading edge of the substrate A1 will be above the leading edge of the succeeding substrate A2 to superpose the substrate A1, A2 above each other. The position of placement of a substrate A1 over a subsequent substrate A2 is shown by the cylinder 16", which merely illustrates the cylinder 16 at a later period of time. Cylinder 16" has already placed the substrate A1' on a succeeding substrate A2'. The grippers insure alignment, but do not grip the leading edges anymore, and permit the two substrates to pass in a straight-forward path along the transport belt 12 to provide the output A1, A2 shown again in alignment with the substrate A2' for simplicity. For example, the substrate A1 may carry advertising for ladies' wear, the substrate A2 advertising for men's wear. Upon further transport of the substrates A1, A2, above each other and in alignment along the belt 12 to the longitudinal folding apparatus 13, 14, making a third fold—or a second longitudinal fold, respectively—both substrates A1, A2 are folded within each other, for ease of separation by a reader but also for ease of insertion as a unit into a newspaper, magazine or other periodical.

It is, of course, also possible to modify the apparatus and guide the respective substrate A1 about the cylinder 16 by a belt engaging around the substrate and around the circumference of the cylinder, in which the grippers 16', then, rather than acting as grippers, will act as deflection elements at the instant of time of transfer.

The path taken by the substrate A1, thus, is not straight through the appartus as the path taken by the substrate A2; rather, it is a detour path, in the embodiment illustrated about the circumference of the cylinder 16.

Figure 3:
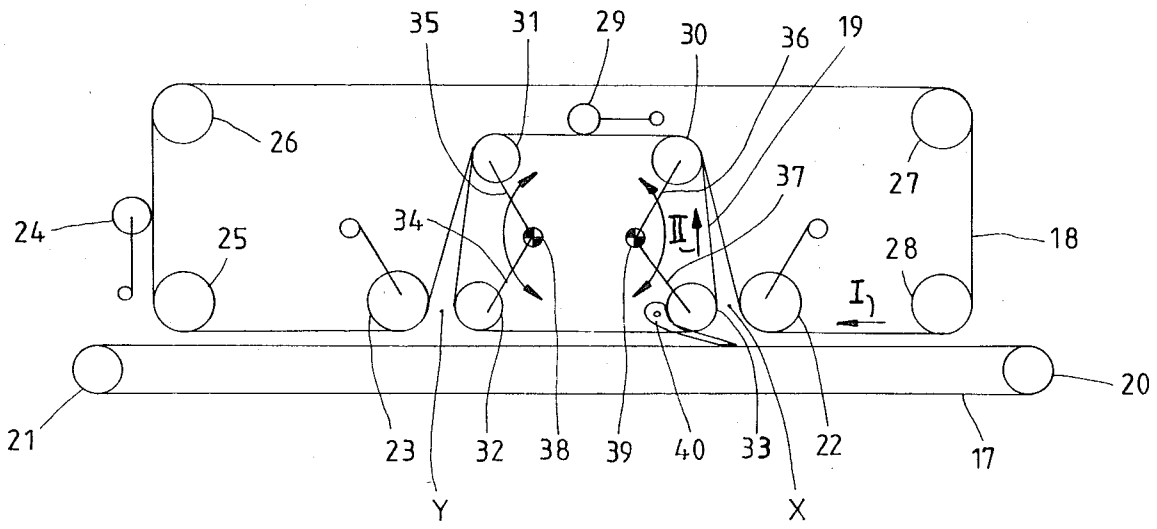
FIG. 3 is a detail view of one arrangement of the collection and assembly apparatus, in schematic representation.

The collection and assembly apparatus may also be constructed as shown, for example, in FIG. 3, and utilize three belts or belt assemblies 17, 18, 19. The substrates, again, are supplied from the right on a lower straight belt 17, guided, as well known, by deflection rollers 20, 21, as shown in FIG. 3. Drive motors and the like to move the respective belts have been omitted for clarity and can be in accordance with any standard and well known construction. An upper belt line 18 is shown, which generally operates in a bridge-shaped or approximately M-shaped path. Belts 18 and 20 operate at their adjacent runs in the direction of the arrow I. Printed substrates arriving from the right are gripped between the belts 17, 18 and will reach the inlet portion X of the apparatus. The printed substrates, if deflected by the deflection switch 14, then pass via a detour path between the belt 18 and an adjacent belt 19, operating in the direction of the arrow II to be delivered at the exit region Y back to belt transport system defined by the upper run of the belt 17 and belt 18. A subsequent substrate which passes straight through between belt 17 and belt 19—now operating in the opposite direction—will be transported such that it reaches the exit zone or region Y at the time when the prior substrate has reached the same zone, so that, upon subsequent gripping between the belts 17, 18, the two sequential substrates will now be in edge alignment.

The outer belt 18 is guided over respective deflection and guide rollers 22, 23. A tensioning roller 24 is provided to adjust the tension of the belt 18. Additional guide rollers 25, 26, 27, 28 guide belt 18 in a closed loop.

Tensioning roller 24 is preferably located between, for example, rollers 25 and 26.

The bridge-like portion of the belt 18 is formed between the rollers 22, 23; rollers 22, 23 may be adjustable in their position lengthwise of the belt 17, as schematically indicated; alternatively, the rollers 22, 23 can be tensioning rollers. A further tensioning roller 29 is applied against the belt 18 at the transverse bridge portion, located between upper deflection and guide rollers 30, 31. The tensioning roller 29 simultaneously tensions the belt 18 as well as an inner belt 19, between which printed substrates introduced between the belts 18 at the inlet zone X are gripped. Tensioning and deflection rollers 32, 33 are located at preferably about the same height as the tensioning and deflection rollers 22, 23 for the belt 18, rollers 32, 33 only carrying the belt 19. As illustrated in FIG. 3, the tension and deflection rollers 32, 31 and 30, 33 are coupled, in pairs to a pivot lever and arm connection 34, 35 and 36, 37, respectively, the arms being pivoted at pivot points 38, 39. Adjustment of the pivot points can change the path length of the detour path between the zones X and Y to such an extent that sequentially arriving printed substrates will be placed at the output zone of the detour path, that is, at zone Y, with their edges in alignment.

Various structural arrangements are possible, for example rollers 30, 31, 32, 33 may be individually adjustably journalled, for example by locating their bearings on threaded rods, or the like, in order to change the position and length of the detour path. Of course, if the detour path is changed by shifting or pivoting of the rollers 30, 31 and 32, 33, the tensioning and deflection rollers 22, 23 may also require re-positioning so that a defined inlet zone X and outlet zone Y for the detour path is maintained. The tongue 40 forms a controlled deflection element, located at the inlet zone X, for deflecting selected substrates arriving between the belts 17, 18 from the right, for example deflecting all odd-numbered substrates while permitting the even substrates to pass on the belt 17 to the zone Y. The counter-operating portion of the belt 19 above the upper run of the belt 17 may be raised so as not to contact any printed substrates thereon. If necessary, a suitable short holding belt, as well known, can be placed between belts 19 which can be arranged in spaced location, adjacent each other, in planes spaced from and parallel to the plane of the drawing of FIG. 3, as well known in the belt transport art in connection with the feeding of printed subject matter.

The selection of the respective substrates A1, A2, as they are transported on the transport belts 12, is synchronized with the operation of the switch, directing the respective substrates A1, A2 in the selected path, the switches being formed, in the embodiment of FIG. 2, by the grippers 16', and in the embodiment of FIG. 3 by the switch blade 40. The synchronization of the operation is readily effected by, for example, sensing the speed or arrival of a specific substrate at a specific point, for example by an optical gate or optical sensor which transmits a signal to a gripper control unit C which, in turn, operates the grippers, for example by controlling the position of a cam on the cylinder 16 to cause the grippers 16' to retract or grip a substrate, respectively; by electromagnetic operating elements or the like. The control of grippers based on a command which may be mechanical or electromechanical is well known and may be in accordance with any conventional system. The deflection switch 40, likewise, can be controlled from the output of the gripper control unit C, not shown in FIG. 3 for simplicity. The embodiment of FIG. 3 has the added advantage that the detour path defined by the belts 18, 19 is adjustable, so that the detour path length can be varied, as desired, to accomodate printed copy substrates A1, A2 of different lengths; in the embodiment of FIG. 2, interchange of the cylinder 16 would be required, or loss of operating time, if a portion of the circumference of the cylinder is not utilized.

I claim:

1. Printed copy folding and assembly apparatus comprising a first transverse folding means (5, 7) to form a transverse fold in a copy (A) being applied thereto;

a second folding means (13, 14) to form a further fold in the copy supplied thereto;

transport means (12) transporting the first folded copy from the first folding means to said second folding means; and a collection and assembly means (15; 16, 16', 16''; 17–40) for separating the copy into copy of a first type (A1) and copy of a second type (A2), and assembling the copy of the first type (A1) with the copy of the second type (A2) prior to the formation of the second fold in said second folding means (13, 14), interposed between said first and second folding means, said collection and assembly means (15) including, means for selectively transporting the copy of the first type or the copy of the second type in a first path which is essentially straight through the collection and assembly means or, selectively, in a second path (X-Y) which defines a detour, and returns the copy transported via the second detour path over the copy transported via the first, essentially straight path with the edges of said copies of both types in alignment, and switching means (16', 40) in the path of the copies of both types being supplied to the selective transport means and determining which type of the copy is to be transported through which one of the selected paths, and guiding said copy in the selected path.

2. The apparatus of claim 1, further including a folding former receiving a continuous printed web (2) and forming a first longitudinal fold;

cutting means downstream of the travel of the web from the folding former (1) and severing said web into two superimposed web portions;

said several web portions being transported to said first transverse folding means (5, 7), and said first transverse folding means comprises a folding blade—folding groove and gripper cylinder pair (5, 7).

3. The apparatus of claim 1, wherein the second folding means (13, 14) are longitudinal folding means forming a longitudinal fold in the printed copy delivered from said collection and assembly means to form a common longitudinal fold therein.

4. The apparatus of claim 2, wherein the second folding means (13, 14) are longitudinal folding means forming a longitudinal fold in the printed copy delivered from said collection and assembly means to form a common longitudinal fold therein.

5. The apparatus of claim 1, wherein (FIG. 2) the collection and assembly means comprises a rotary cylinder (16) including selectively operable grippers to selectively grip selected copies of a first type (A1), transport said gripped copies about the circumference, and release the so transported and gripped copies in edge alignment with a substrate of the second type (A2) above the copy of the second type, being transported to the collection and assembly means by said transport means (12).

6. The apparatus of claim 1, wherein the collection and assembly means comprises a rotating cylinder (16), and the switching means comprises means (16'; 40) selectively directing printed copies (A1) arriving beneath the cylinder to pass around the cylinder or to pass therebeneath without passing about the cylinder.

7. The apparatus of claim 1, wherein (FIG. 3) the collection and assembly means comprises a belt system (17, 18, 19) defining both said first, essentially straight-through path and said detour path (X-Y);

and the switching means (40) comprises a deflecting tongue located at the entrance to the detour path and selectively blocking the straight-through path and directing printed copy into the detour path, or releasing the entrance to the straight-through path.

8. The apparatus of claim 7, wherein the belt system in the detour path comprises an outer (18) and an inner (19) belt;

and wherein re-positionable belt guide rollers (30, 33) are provided; and means (34, 35; 36, 37), to change the position of the belt guide and deflection rollers (30–33) and hence change the length of the detour path defined by the inner and outer belts.

9. The apparatus of claim 8, further comprising tension rollers (30, 31) simultaneously tensioning both the inner and outer belts.

10. The apparatus of claim 7, further including tensioning rollers (22, 23) located adjacent the entrance (X) and the exit (Y) of the detour path and in engagement with at least (18) of the belts (17, 18, 19) of the belt system to provide for tensioning of said at least one belt regardless of the length of the detour path.

11. The apparatus of claim 1, wherein the collection and assembly means comprises a movable inner support means (16, 19) for supporting a copy at one side thereof, and guiding, selectively, a selected copy in said detour path;

and a belt (18) engageable with the other side of the copy to retain the selected copy traveling in said detour path against said support means.

12. The apparatus of claim 11, wherein said support means comprises a rotating cylinder (16) and the switching means comprises deflection elements coupled to the rotating cylinder.

* * * * *